United States Patent [19]

Viesturs et al.

[11] 4,350,195

[45] Sep. 21, 1982

[54] DEVICE FOR STORING DOCUMENTS

[76] Inventors: Gundar Viesturs, Oak Hill Dr.; Eric A. Viesturs, 680B Heritage Village, both of Southbury, Conn. 06488

[21] Appl. No.: 235,925

[22] Filed: Feb. 19, 1981

Related U.S. Application Data

[63] Continuation of Ser. No. 25,119, Mar. 29, 1979, abandoned.

[51] Int. Cl.[3] ..... A45C 1/06

[52] U.S. Cl. ..... 150/39; 281/45; 402/79; 402/80 R; 402/500

[58] Field of Search ..... 150/39, 35; 402/500, 402/79, 80 R; 281/45

[56] References Cited

U.S. PATENT DOCUMENTS

| | | | |
|---|---|---|---|
| 1,332,159 | 2/1920 | Buck | 402/79 |
| 1,354,894 | 10/1920 | Delkin | 402/79 |
| 2,694,429 | 11/1954 | Berger | 150/39 |
| 3,324,918 | 6/1967 | Miller | 150/39 |
| 3,367,340 | 2/1968 | David et al. | 150/39 X |
| 3,433,279 | 3/1969 | Seamon | 150/39 |

*Primary Examiner*—Donald F. Norton

[57] ABSTRACT

A device for storing documents is provided with a flat rectangular member. A rectangular strip is disposed above and overlies one side of one surface of said member. A plurality of posts are employed, said posts being disposed between and secured to said strip and said member in spaced apart positions. A flexible rectangular sheet has at least one section having on one side thereof a like plurality of notches. Each notch is aligned with and detachably engages a corresponding post. The section can have a pocket for storing documents therein.

6 Claims, 8 Drawing Figures

DEVICE FOR STORING DOCUMENTS

CROSS REFERENCE TO COPENDING APPLICATIONS

This application is a continuation in part of copending application, Ser. No. 025,119 filed Mar. 29, 1979, now abandoned.

SUMMARY OF THE INVENTION

The present invention is directed toward a device for storing documents such as a folder, wallet or flat support to which a sheet containing one or more sections can be removably attached, each section containing a pocket in which documents can be removably inserted.

The device utilizes one or two rectangular flat members when two members are used, one side of one member is placed adjacent one side of the other member and hinge means interconnects these two adjacent sides whereby the two members can be folded one upon the other and unfolded from each other to define an essentially common surface which includes one surface of each member.

A rectangular strip is disposed above and overlies one side of one surface of one of the members. This strip can extend over essentially the entire surface of the said one member and can be secured peripherally to all sides of the said one member other than said one side.

A plurality of posts are disposed between and are secured to the strip and the said one member in spaced apart positions.

A flexible rectangular sheet has at least one section having essentially the same shape as the said one member and smaller than the member. This section has a like plurality of notches, each notch being aligned with and detachably engaging a corresponding post. The section can contain a pocket for storing documents.

DETAILED DESCRIPTION OF PREFERRED EMBODIMENTS

Figure 1:
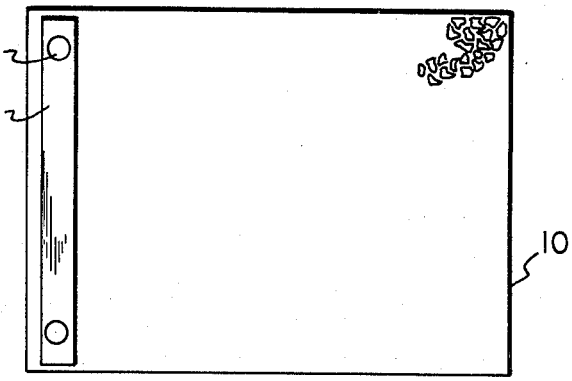
FIG. 1 is a top plan view of one structure employed in the invention.
Figure 3:
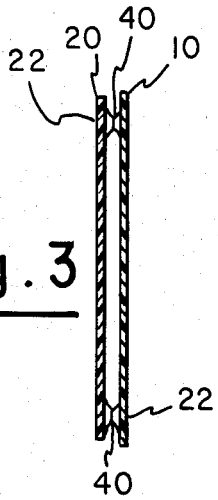
FIG. 3 is a view taken along line 3—3 in FIG. 1.
Figure 2:
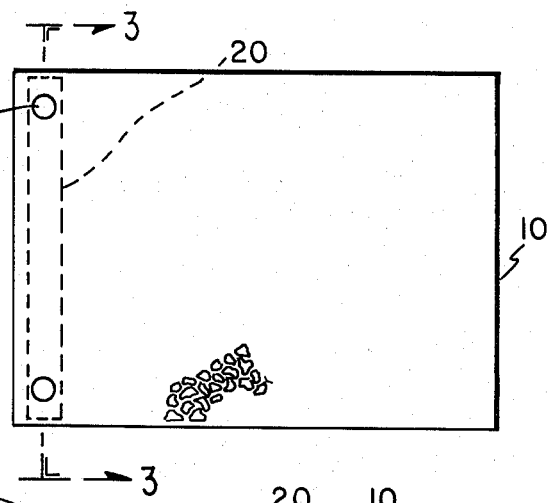
FIG. 2 is a bottom plan view thereof.

Referring first to FIGS. 1–3, a flat plastic rectangular member 10 relatively rigid has top and bottom surface. A rectangular strip 20 of plastic overlies the top surface of member 10 along one side thereof. The strip and member are heat sealed together at two spaced points 22 forming depressions in the top surface of strip 20 and bottom surface of member 10. These depressions form integral connections or posts 40 between the member and strip.

Figure 4:
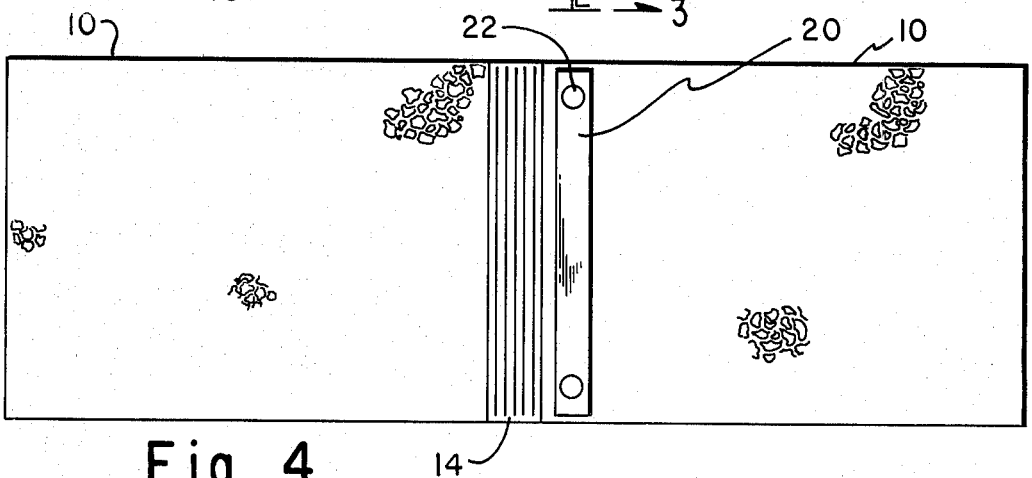
FIG. 4 is a top plan view of another structure employed in the invention.
Figure 5:
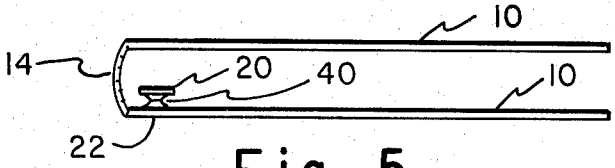
FIG. 5 is a view of the structure of FIG. 4 shown in folded position.

As shown in FIGS. 4 and 5, a second like member 10 can be integrally and hingedly secured at 14 to first member 10. While FIG. 5 shows strip 20 secured to member 10 by posts 40 and shows second member 10 without a corresponding strip or posts, the second member could be provided with its own strip and posts.

The number of posts used will depend upon the size of the members. A minimum of two posts as shown are required but three or more posts can be employed where necessary.

Figure 6:
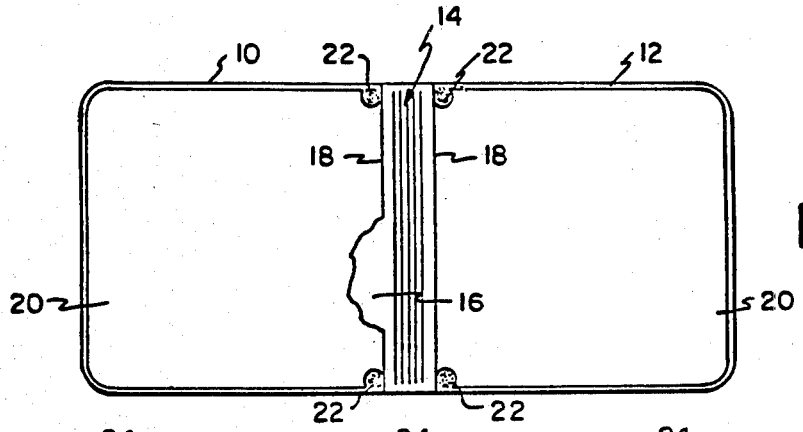
FIG. 6 is a top plan view of a modification of the structure of FIG. 5.

In FIGS. 1–5, the members are notebook sized. In FIG. 6, the members 10 are wallet sized and each member is covered with a corresponding strip 20. However, in FIG. 6, each strip 20 overlies essentially the entire top surface of corresponding member 10 and is peripherally secured thereto on all sides of member 10 except the side connected to the hinge means 14. Each strip 20 thus forms a pocket with the corresponding member which is accessible via corresponding opening 18. Each of the two posts associated with each pocket are disposed adjacent corresponding ends of the opening as indicated by the depression points 22.

Figure 7:
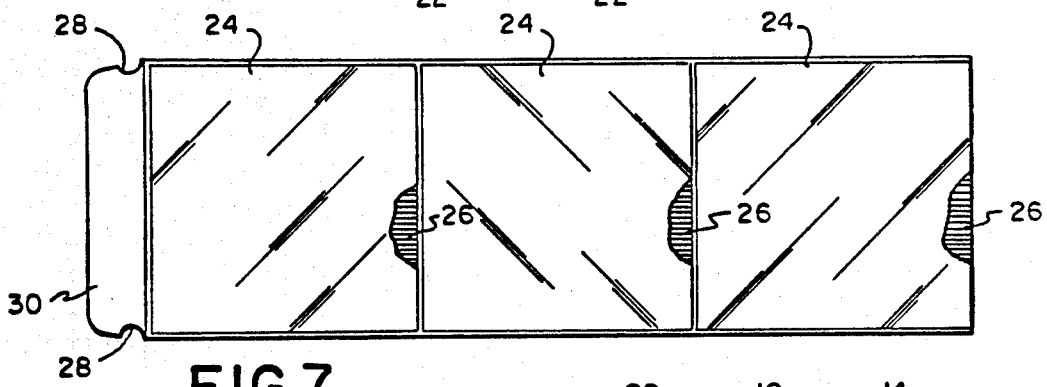
FIG. 7 is a top plan view of a flexible sheet used in the invention.
Figure 8:
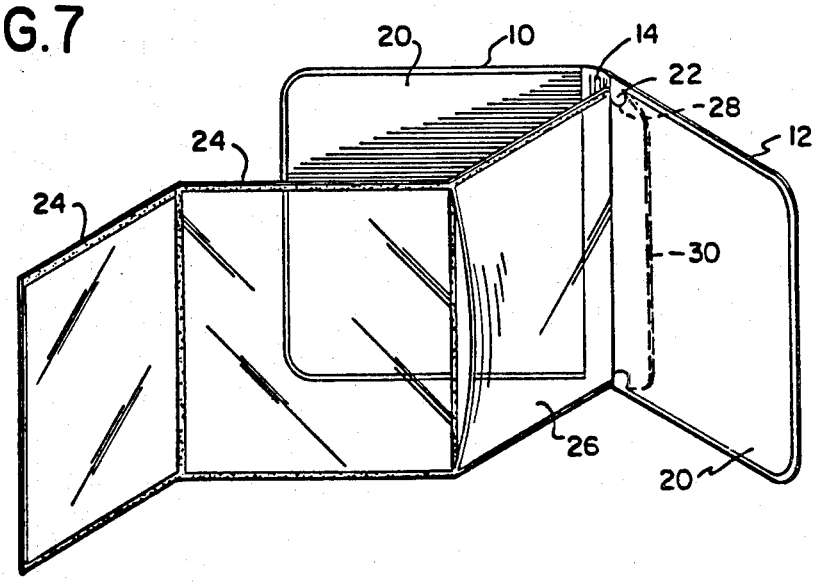
FIG. 8 is a perspective view of the sheet of FIG. 7 as inserted in the modification of FIG. 6.

FIG. 7 shows a flat elongated rectangularly shaped transparent plastic sheet having a plurality of sections 24 foldable one upon the other, each section having a rectangular pocket 26. The first section has a flap 30 with rounded corners. This flap has two notches 28, each notch being manually engagable with, or disengagable from a corresponding post 40 to secure the flap detachably between a strip and a corresponding member as shown in FIG. 8.

What is claimed is:

1. A device comprising:

a flat rectangular first member;

a rectangular strip disposed along and overlying one side of one surface of said member;

a plurality of posts, said posts being disposed between and secured to said strip and said member in spaced apart positions; and a flexible rectangular sheet having at least one section having essentially the same shape as said member and smaller than said member, said section containing a pocket for storing documents, said section having on one side thereof a flap having a like plurality of notches, each notch being aligned with and detachably engaged to a corresponding post.

2. The device of claim 1 further including a second like member having one side disposed adjacent said one side of said first member and hinge means interconnecting said one side of the first member and said one side of the second member whereby said members can be folded upon each other and unfolded from each other to define an essentially common surface which includes said one surface of said first member.

3. The device of claim 2 wherein said sheet has a plurality of sections foldable one upon the other.

4. A device comprising:

first and second like flat rectangular members, one side of each member being disposed adjacent one side of the other member;

hinge means interconnecting the adjacent sides of the two members whereby said members can be folded upon each other and unfolded from each other to define an essentially common surface which includes one surface of each member;

first and second like rectangular strips, each one of the strips being disposed above the one surface of the corresponding member and overlying the said one side of the corresponding one of the members;

first and second sets of posts, each set containing a like plurality of posts, the posts in each set being disposed between and secured to the corresponding one of the strips and the corresponding one of the members; and a flexible rectangular sheet having at least one section having essentially the same shape as either member and smaller than either member, said sheet having on one side thereof a flap having a like plurality of notches, each notch being aligned with and detachably engaging a corresponding one of the posts on either one of the sets.

5. The device of claim 4 wherein each strip extends over substantially the entire one surface of the corresponding one of the members and is peripherally secured to all sides but said one side of the corresponding one of said members.

6. The device of claim 5 wherein said section contains a pocket for storing documents.

* * * * *